US005887729A

United States Patent [19]

Sugiyama

[11] Patent Number: 5,887,729

[45] **Date of Patent: *Mar. 30, 1999**

[54] AUTOMATIC SORTING APPARATUS

[76] Inventor: Hiroaki Sugiyama, 22-7 Shinmachi, Mutsu-shi, Aomori-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 558,690

[22] Filed: Nov. 14, 1995

[30] Foreign Application Priority Data

| | | | |
|---|---|---|---|
| Nov. 18, 1994 | [JP] | Japan | 6-309537 |
| Feb. 27, 1995 | [JP] | Japan | 7-061605 |

[51] Int. Cl.[6] ..... B07B 13/05

[52] U.S. Cl. ..... 209/665; 209/308; 209/397

[58] Field of Search ..... 209/307, 308, 209/397, 399, 659, 660, 665

[56] References Cited

U.S. PATENT DOCUMENTS

| | | | |
|---|---|---|---|
| 1,332,305 | 3/1920 | Ross | 209/307 |
| 1,337,351 | 4/1920 | Furbush | 209/307 X |
| 1,609,442 | 12/1926 | Thompson | 209/665 |
| 1,695,371 | 12/1928 | Felde | 209/307 X |
| 2,386,714 | 10/1945 | Pharo | 209/308 X |
| 3,621,997 | 11/1971 | Hobbs | 209/307 X |

FOREIGN PATENT DOCUMENTS

| | | | |
|---|---|---|---|
| 1641463 A1 | 4/1991 | U.S.S.R. . | |
| 1733123 | 5/1992 | U.S.S.R. | 209/307 |
| 1808426 | 4/1993 | U.S.S.R. | 209/665 |

*Primary Examiner*—Tuan N. Nguyen
*Attorney, Agent, or Firm*—Oliff & Berridge, PLC

[57] ABSTRACT

The invention concerns an automatic sorting apparatus for sorting out pieces under process, such as fish and shellfish or industrial products, into different size groups. In the prior art automatic sorting apparatus, pieces under process are readily caught in sorting holes, making it difficult to obtain smooth sorting. The invention permits smooth sorting. An automatic sorting apparatus to this end includes an endless conveyor having sorting holes and capable of excursion, an inner receiver disposed inside the endless conveyor for receiving pieces under process falling from the sorting holes, and an outer receiver disposed outside and below a U-turn portion of the endless conveyor for receiving pieces under process falling off the U-turn portion. Another automatic sorting apparatus includes two or more endless conveyors having different excursion diameters and disposed one inside another at an interval. The sorting holes of each endless conveyor are smaller than those of the next outer endless conveyor. An inner receiver is disposed inside the innermost endless conveyor for receiving pieces under process falling through the sorting holes of that endless conveyor. An outer conveyor is disposed outside and below a U-turn portion of each endless conveyor for receiving pieces under process falling through the sorting holes of that endless conveyor.

9 Claims, 11 Drawing Sheets

AUTOMATIC SORTING APPARATUS

BACKGROUND OF THE INVENTION

1. Field of the Invention

This invention relates to an automatic sorting apparatus for sorting out various kinds of fish and shellfish, such scallops, pearl oysters, oysters, shipimi clams, asari clams, fish, etc., such minerals as stones and gravels, crops, industrial products of various shapes and so forth into different outer size groups.

2. Prior Art

Scallops are sorted out into different size groups in the breeding and shipment seasons. The sorting was made earlier manually. Specifically, it was done with sorting tools (for instance sheaves) having sorting holes of different sizes. The scallops to be sorted were first put into the sorting tool having the largest sorting holes, and the tool was shaken to sort out scallops smaller than the sorting holes. The sorted-out scallops were then put into the sorting tool having the next largest sorting holes to sort out scallops smaller than the sorting holes by shaking the tool. In this way, the scallops to be sorted were sorted out progressively a certain number of times with sorting tools having progressively smaller sorting holes to obtain scallop groups of different sizes. This method of sorting is very inefficient and dictates great fatigue burden the person who carries our the sorting.

The applicant has earlier developed an automatic sorting apparatus as shown in FIG. 12 for practical use. This apparatus has three shooters B disposed one above another and having a gently downward slope. The uppermost shooter B1 has a large number of comparatively large sorting holes C1. The second shooter B2 likewise has a large number of slightly smaller sorting holed C. The third (i.e., lowermost) shooter B3 has no sorting hole. The lower end of the second shooter B2 is mounted on a frame K via an elastic urethane rod D. An arm E is coupled to the bottom of the upper end of the lowermost shooter B3. The shooters B are reciprocated in their longitudinal directions (i.e., back and forth) by driving the arm E from a motor M.

Above the uppermost shooter B1 a hopper F is disposed such that it is inclined oppositely to the shooter B1. The hopper F has its lower end (outlet) supported on a roller O and its upper end coupled rotatably at the bottom to the upper end a coupler P which is like an elongate plate in shape. The coupler P has a vertically intermediate portion mounted on a substantially horizontal shaft R which is rotatably supported on triangular upright supports Q provided on the width direction opposite sides of frame. Its lower end is mounted on the uppermost shooter B1. As the uppermost shooter B1 is reciprocated back and forth, the lower end of the coupler P is reciprocated in the same directions to cause rotation of the upper end of the coupler P and reciprocation of the hopper F in the opposite directions to the reciprocation of the uppermost shooter B1.

In operation, scallops A to be sorted out are put into the hopper F, and the three shooters B1 and B3 are reciprocated simultaneously. The hopper F is thus reciprocated in the opposite directions, and scallops A therein fall onto the uppermost shooter B1 and side down along the fall off the shooter B1 into a box D disposed below. During this time, scallops A which are smaller in size than the sorting holes C1 of the shooter B1, fall through the holes C1 onto the second shooter B2 to slide down and fall off the second shooter B2 onto a second box H disposed below. Again during this time, scallops A smaller than the sorting holes C2 of the second shooter B2, fall through the holes C2 onto the lowermost shooter B3 to slide down and fall off the shooter B3 onto a third box I disposed below. In the above way, the scallops are sorted out to be accommodated in different size groups in the boxes G to I.

As the prior art automatic sorting apparatus, there has also been one of drum type. In this type, the work such as shellfish to be sorted out is put into a hollow cylindrical drum, and then the drum is rotated. As a result, pieces of the work which are smaller than a number of sorting holes formed in the drum periphery, are caused to fall through the sorting holes.

PROBLEMS TO BE SOLVED IN THE PRIOR ART

The above FIG. 12 automatic sorting apparatus has fairly feasible sorting performance. However, the work scallops A to be sorted have been grown very variously. As for their shape, they are not truly circular, but they have small diameter portions (thin portions) and large diameter portions (thick portions). Their small diameter portions may pass through sorting holes which are truly circular, but their large diameter portions may not pass through but may be caught in the holes. When a scallop A is caught in a sorting hole, succeeding scallops A may be stopped progressively by the caught scallop. Consequently, scallops A are collected on the shooter B1 or B2, thus deteriorating the flow of scallops A and reducing the sorting efficiency. In an extreme case, the flow is stopped to disable the sorting.

When scallops A are collected on the shooter B1 or B2 as described above, it is necessary to feed out the collected scallops A manually, or manually take out the scallop caught in the sorting hole. This operation is very cumbersome. When a scallop is caught tightly in a sorting hole, it takes a considerable time to take out the caught scallop, so that it is necessary to interrupt the reciprocation or vibration of the shooters B1 to N3, thus resulting in operation efficiency reduction. Moreover, the catching of scallops causes damage to sorting hole edges, and in long use the sorting hole side is increased from the initial size, thus disabling highly accurate sorting. A further drawback is that when scallops A are held collected on shooter B without being noticed, succeeding scallops A may overflow and fall off the shooter B or proceed over the collected scallops A, that is, scallops A which should fall through the sorting holes may pass the shooter without falling to result in the mixing of different size scallops A and deteriorate the accuracy of sorting.

The prior art drum type automatic sorting apparatus has a demerit that many shellfish pieces accommodated in the drum overlap one another to make it difficult the progress of shellfish pieces over sorting holed formed in the drum periphery. The sorting efficiency, therefore, has been unsatisfactory.

SUMMARY OF THE INVENTION

An object of the invention is to provide an automatic sorting apparatus, which permits smooth sorting of various kinds of fish and shellfish, such as scallops, pearl oyster, oysters, shipimi clams, asari clams, fish, etc. without possibility of catching of these pieces under process, and more particularly an automatic sorting apparatus, which can sort out not only fish and shellfish but also any pieces under process, such as stones, gravels and other minerals, crop, industrial products in spherical, granular or powdery form, etc.

According to the invention, there is provided an automatic sorting apparatus, which comprises an endless conveyor capable of excursion and having sorting holes permitting falling therethrough of pieces under process having at least a predetermined size, and inner receiver disposed on the inner side of the endless conveyor for receiving pieces under process falling through the sorting holes, and an outer receiver disposed outside and below a U-turn portion of the endless conveyor for receiving pieces under process falling off the U-turn portion.

According to the invention, there is also provided an automatic sorting apparatus, which comprises two or more endless conveyors having different excursion diameters and each having sorting holes permitting falling therethrough of pieces under process having at least a predetermined size, these endless conveyors being disposed for excursion at an interval between adjacent ones, the sorting holes of each of the endless conveyors being smaller than the sorting holes of the next outer endless conveyor, an inner receiver disposed on the inner side of the innermost endless conveyor for receiving pieces under process falling through the sorting holes of the innermost conveyor, and outer receivers each disposed outside and below each of the endless conveyors but the innermost one for receiving pieces under process fall off a U-turn portion of each endless conveyor but the innermost one.

DETAILED DESCRIPTION OF THE PREFERRED EMBODIMENTS

Figure 12:
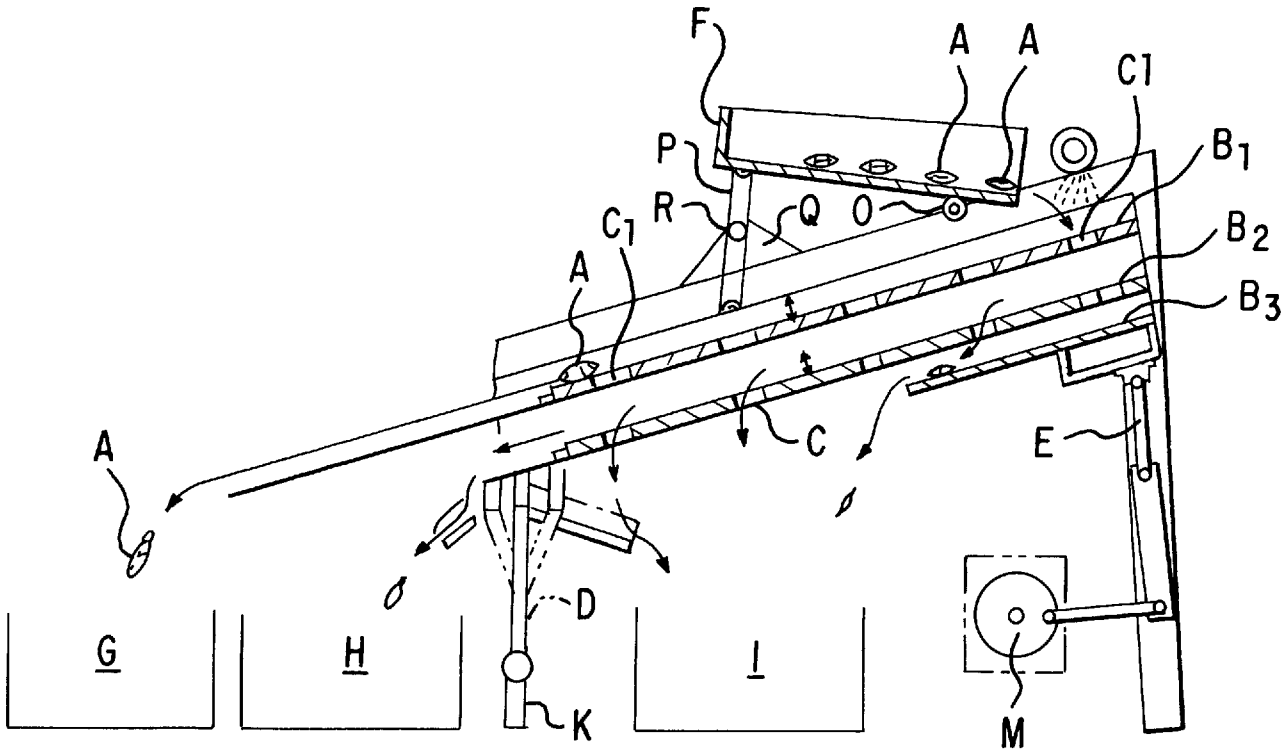
FIG. 12 PRIOR ART
FIG. 12 is a side view, partially broken away, showing a prior art automatic sorting apparatus.

A first embodiment of the automatic sorting apparatus according to the invention will now be described in detail with reference to FIGS. 1A and 1B to 3A and 3B. This embodiment comprises an endless conveyor 2 passed round a drive roll 15 and a driven roll 31. By causing rotation of the drive roll 15, the endless conveyor 2 is driven for excursion while rotating the driver roll 31. The endless conveyor 2 may, as shown in FIG. 12, be a thin sheet 2*b* of a hard material (for instance a stainless steel sheet) having a number of sorting holes 1. Or it may, as shown in FIGS. 3A and 4, comprise a number of hard material panels 6 having sorting holes 1 and coupled for bending to one another. In the FIG. 1B case, the single thin sheed 2*b* is desirably as thin as being able to readily form a U-turn portion 5 of the endless conveyor 2 while the endless conveyor 2 undergoes excursion.

The endless conveyor 2 has its upper run 2*a* supported by rotatable support members 18 such as sprockets or rollers disposed at a suitable interval in the direction of excursion to prevent downward sagging of the upper run 2*a* and ensure its smooth excursion. It is arranged that the endless conveyor 2 is not detached from the drive and driven rolls 15 and 31 when it is vibrated up and down by a vibrator 7 (FIGS. 5 and 11A) to be described hereinunder.

Inside the endless conveyor 2 and inner receiver 41 is disposed, which receives pieces 3 under process (i.e., scallops in this embodiment) falling through the sorting holes 1. Outside and below the U-turn portion 5 of the endless conveyor 2 an outer receiver 42 is disposed, which receives pieces 3 under process that are conveyed on the endless conveyor 2 without falling through the sorting holes 1 and falling off the U-turn portion 5 of the endless conveyor 2. The inner and outer receivers 41 and 42 have a downward slope toward front in a perpendicular direction to the direction of excursion of the endless conveyor 2 so that the pieces 3 under process falling onto them can slide automatically along them to the outside.

In the automatic sorting apparatus shown in FIGS. 1A and 1B, 3A and 3B, while pieces 3 under process supplied onto the endless conveyor 2 undergoing excursion, those pieces 3 under process which are smaller than the sorting holes 1 fall through the sorting holes 1 to be received in inner receiver 41 disposed inside. Those pieces 3 under process which are conveyed on the endless conveyor 2 without falling through the sorting holes 1, fall off the U-turn portion 5 of the endless conveyor 2 to be received in the outer receiver 42 disposed outside and below the U-turn portion 5. Consequently, the pieces 3 under process supplied onto the endless conveyor 2, are sorted out into a size group of pieces 3 having fallen through the sorting holes 1 and a size group of pieces 3 not having fallen through.

A second embodiment of the automatic sorting apparatus according to the invention will now be described with reference to FIGS. 2 to 4. In this embodiment, three endless conveyors 2 having different excursion diameters are disposed at a suitable interval. Of these endless conveyor 2, the innermost one is passed round small diameter drive and driven rolls 11 and 12. The intermediate endless conveyor 2 is passed round an intermediate drive roll 13 an intermediate diameter arcuate guide 14. The outermost endless conveyor 2 is passed round a large diameter drive roll 15 and a large diameter arcuate guide 16. The three drive rolls 11, 13 and 15 are concentrically mounted on and driven by a shaft 17 of a motor or like driver. By causing rotation of these drive rolls 11, 13 and 15 the endless conveyors 2 are driven for excursion. As the drive rolls 11, 13 and 15 may be sued sprockets or other rotatable members, which the endless conveyors will not slip against.

Figure 1A:
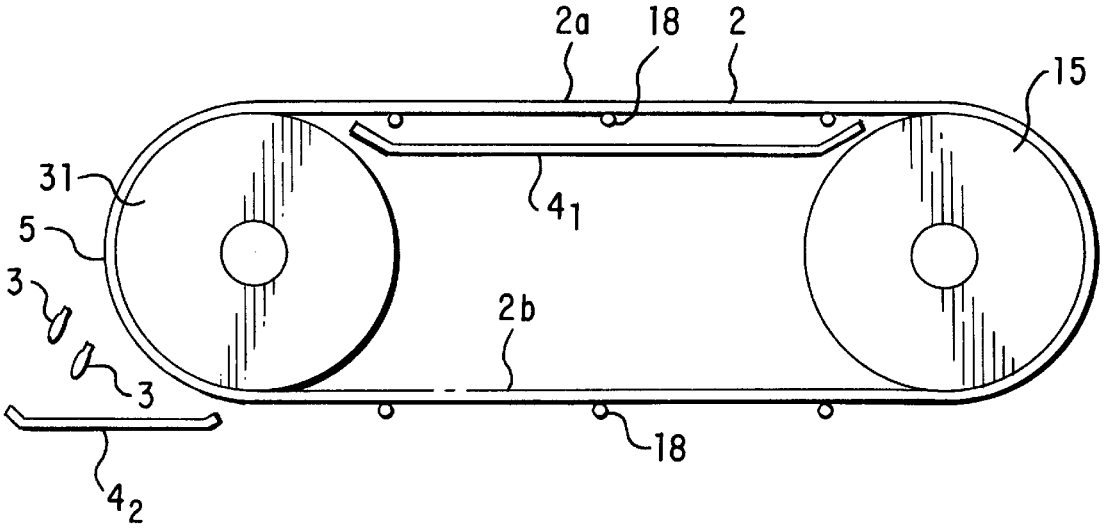
FIGS. 1A and 1B show a first embodiment of the automatic sorting apparatus according to the invention, FIG. 1A being a aside view, FIG. 1B being a fragmentary perspective view.
Figure 2:
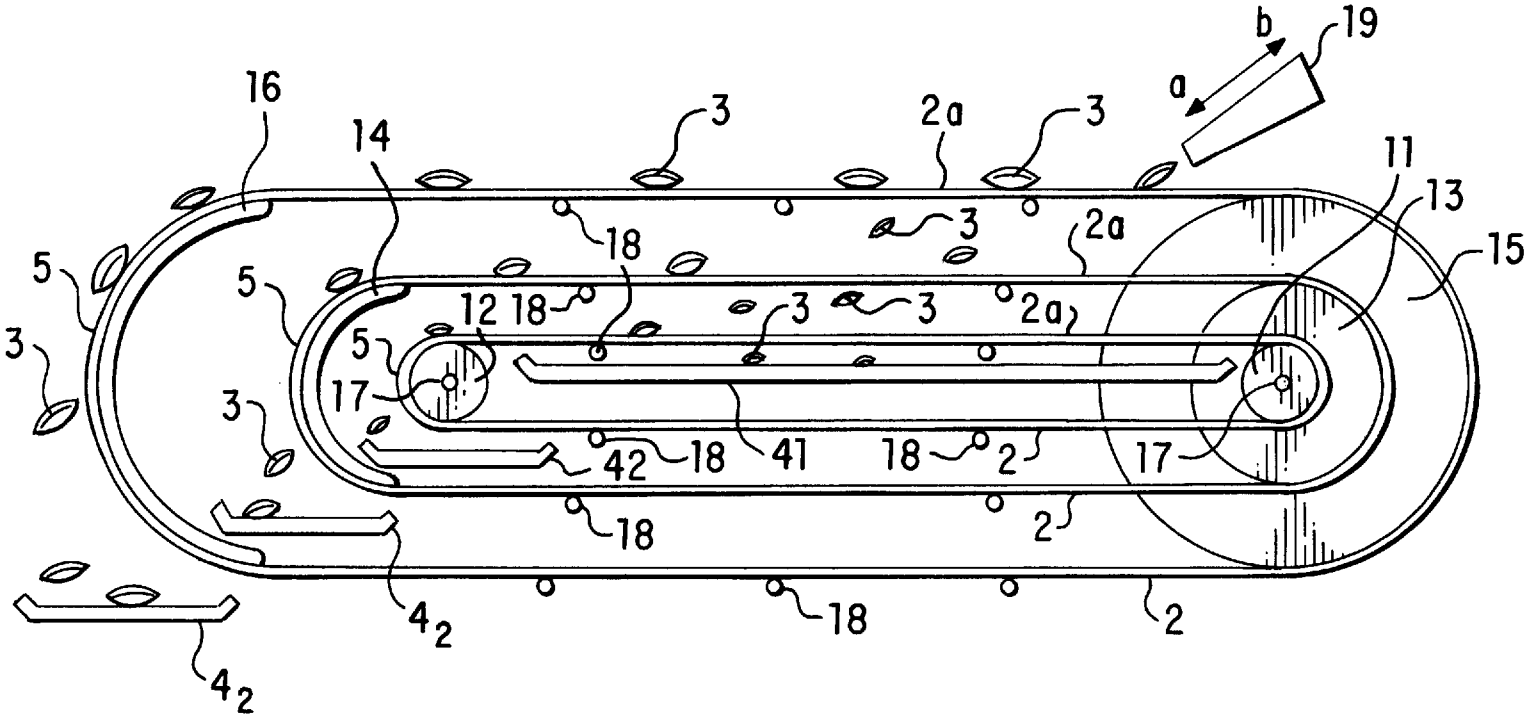
FIG. 2 is a sectional view showing a second embodiment of the automatic sorting apparatus according to the invention.
Figure 3A:
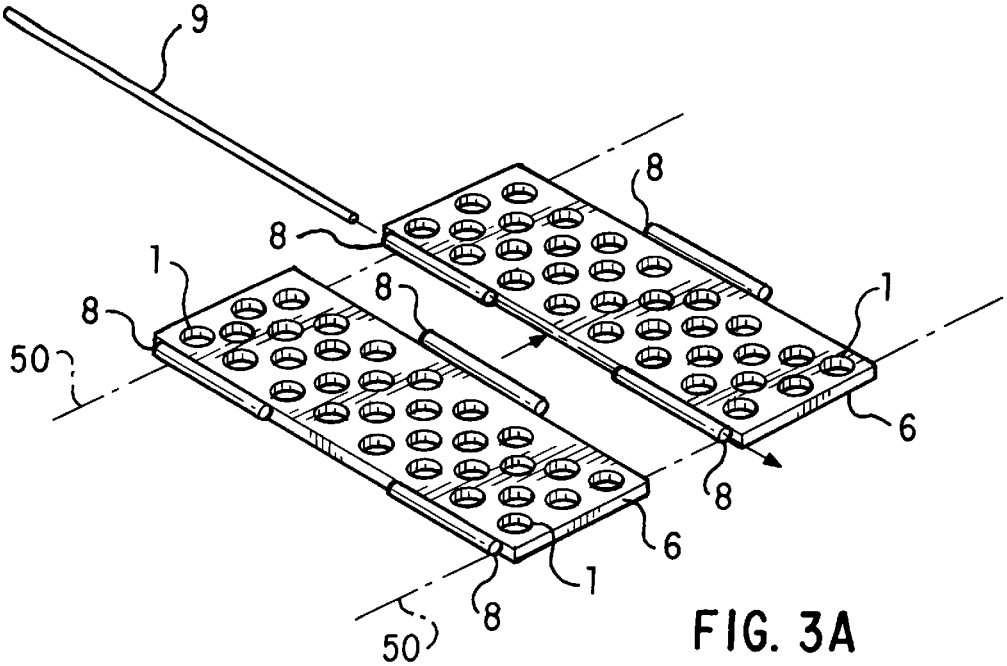
FIGS. 3A and 3B are views showing a first and a second example, respectively, of the way of assembling an endless conveyor in the automatic sorting apparatus according to the invention.

Reference numeral 18 is FIG. 2 designates support members 18, which are like the support members 18 shown in FIG. 1A. These support members 18 are disposed rotatably at a suitable interval under the upper and lower runs 2*a* and 2*b* of each endless conveyor 2.

Endless conveyors 2 shown in FIGS. 3A and 4 are each includes a number of panels 6 made of a hard material, such as metal, hard plastic material, hard rubber, etc. and coupled to one another for bending. The panels 6 each has cylindrical engagement portions 8 formed along the width direction ends. Adjacent ones of the panels 6 are coupled together into an endless form having a predetermined length by aligning their associated cylindrical engagement portion 8 and inserting a coupling pin 9 through the aligned cylindrical engagement portions 8. It is possible as well to couple the panels 6 for bending by using hinges (not shown) or the like.

In the FIG. 3A automatic sorting apparatus, the endless conveyor 2 which is formed by coupling a number of panels 6 having sorting holes 1 to one another for bending, can readily undergo excursion.

Desirably, an endless excursion member 50 such as an endless chain is mounted on the back side of the panels 6 coupled to one another as shown in FIG. 3A and passed round drive members (such as sprockets) 11, 13 and 15 to permit smooth excursion of the endless conveyor 2 without slip. It is possible to replace the chain 50 with any other member which can undergo smooth excursion without round the drive members 11, 13 and 15, for instance a timing belt.

Figure 3B:
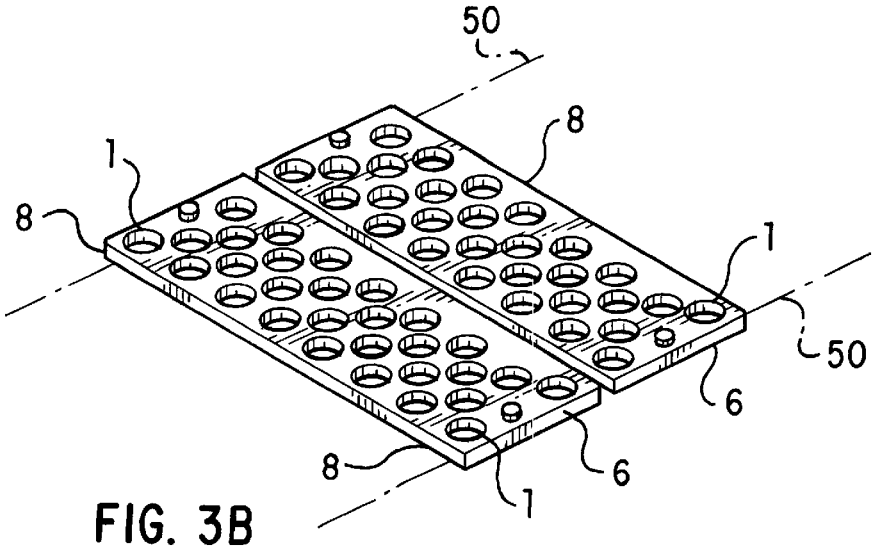
Figure 4:
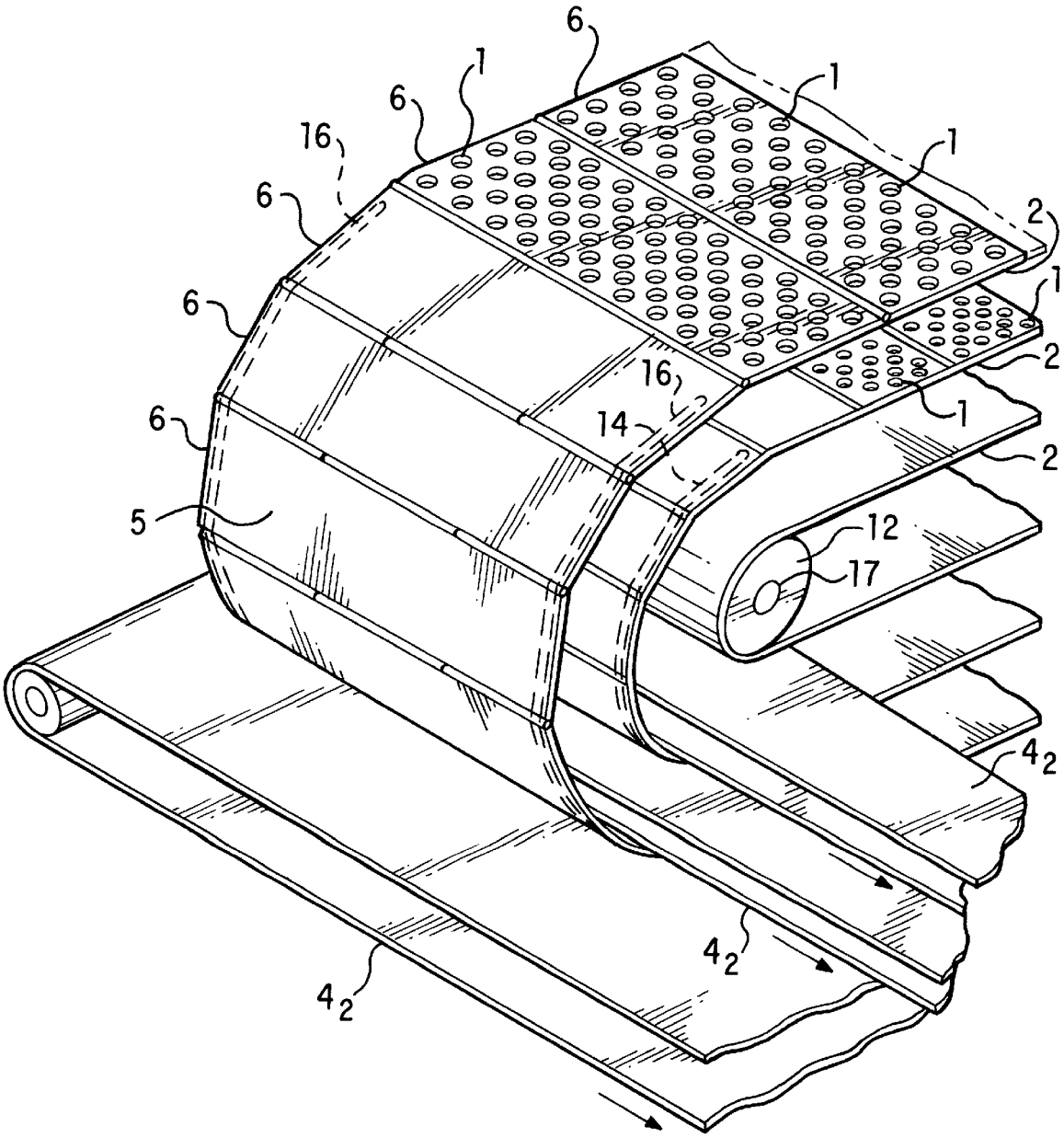
FIG. 4 is a fragmentary perspective view showing U-turn portions of endless conveyors in the automatic sorting apparatus according to the invention.
Figure 10A:
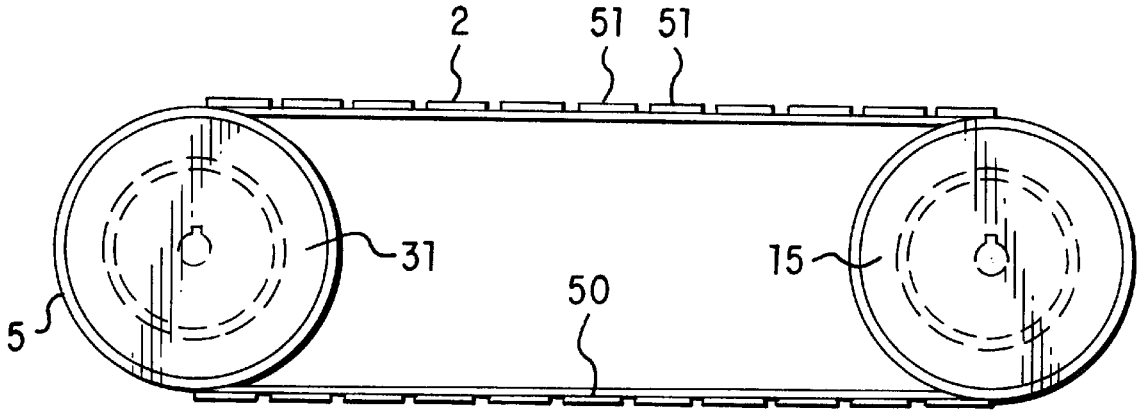
FIGS. 10A and 10B show the FIG. 9 automatic sorting apparatus, FIG. 10A being a schematic side view, FIG. 10B being a fragmentary schematic side view showing a U-turn portion shown in FIG. 10A.
Figure 10B:
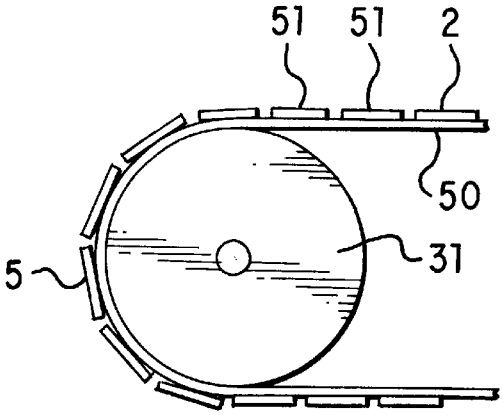

The panels 6 may, as shown in FIG. 3B, each be mounted directly on the endless excursion member 50. In this case, each panel 6 may have its width direction central portion mounted on the endless excursion member 50 so that its width direction leading and trailing end portions are in a free state. This arrangement, as shown in FIG. 10B, permits free ventricle movement of the width direction leading and trailing end portions of the panel 6 at the U-turn portion 5 of the endless conveyor 2, and facilitates excursion of a number of panels 6 with the endless excursion member 50.

As shown in FIGS. 3A and 3B, each panel 6 has a number of sorting holes 1. The panels 6 in the same endless conveyor 2 has sorting holes 1 having a fixed diameter. The sorting holes 1 in each panel 6 may be in a regular or irregular arrangement in any, such as longitudinal, transversal or oblique, direction. The distance between adjacent sorting holes 1 in each panel 6 is suitably smaller than the diameter of the sorting hole 1 to prevent a piece 3 under process, which should fall through the sorting hole 1, from passing by the sorting hole 1 without falling through the same.

In the FIGS. 2 and 4 apparatus, endless conveyors 2 having different excursion diameters are disposed in a concentric arrangement. Each endless conveyor 2 has sorting holes 1 which are smaller than those of the next outer endless conveyor 2, so that pieces 3 under process having progressively smaller sizes are sorted out as they fall from each endless conveyor 2 onto the next inner one. The innermost endless conveyor 2 need not have any sorting hole 1.

In FIGS. 2 and 4, designated at 41 is an inner receiver, and at 42 outer receivers. These receivers 41 and 42 serve to receive pieces 3 under process falling from the associated endless conveyors 2. The inner receiver 41 is disposed inside the innermost endless conveyor 2 and extends in the longitudinal direction thereof for receiving pieces 3 under process falling through the sorting holes 1 of the same endless conveyor 2. The outer receivers 42 are each disposed outside and below the U-turn portion 5 of each endless conveyor 2 for receiving pieces 3 under process falling off the U-turn portion 5.

The inner and outer receivers 41 and 42 may be of various types capable of receiving falling pieces 3 under process, such as box-like vessels, gutter-like shoots, belt conveyors, etc. FIG. 4 shows belt conveyors as an example of the receivers. More specifically, the conveyors 42 each extends side-wise from a position beneath the U-turn portion 5 of each endless conveyor 2 for conveying pieces 3 under process falling off the U-turn portion 5 to the outside of the endless conveyor 2. With this arrangement, pieces 3 under process falling onto the inner and outer conveyors 41 and 42 can be automatically brought to a desired place. Thus, they are not accumulated on the receivers 41 and 42 and do not obstruct succeeding pieces 3 under process falling onto the receivers 41 and 42.

Reference numeral 19 in FIG. 2 designates a hopper, which supplies pieces 3 under process onto the outermost endless conveyor 2. The hopper 19 can be reciprocated in the directions of arrows a-b by a reciprocator (not shown) so that the pieces 3 under process can smoothly fall onto the outermost endless conveyor 2.

In the FIG. 2 automatic sorting apparatus, as pieces under process supplied onto the outermost endless conveyor 2 undergoing excursion are conveyed on the same, those pieces 3 under process which are smaller than the sorting holes 1 fall through the sorting holes 1 onto the inner (i.e., intermediate in FIG. 2) endless conveyor 2. As the pieces 3 under process having fallen through are conveyed on the endless conveyor 2, those pieces 3 under process which are smaller than the sorting holes 1 of the endless conveyor 2 fall through the sorting holes 1 thereof onto the inner (i.e., innermost in FIG. 2) endless conveyor 2. Again as the pieces 3 under process having fallen through are conveyed on the endless conveyor 2, those pieces 3 under process which are smaller than the sorting holes 1 of that endless conveyor 2 fall through the sorting holes 1. The pieces 3 under process which are conveyed on that endless conveyor without falling through the sorting holes 1 thereof, fall off the U-turn portion 5 of that endless conveyor 2 to be received by the outer receiver disposed outside and below the U-turn portion 5. Thus, where there are three endless conveyors 2 as shown in FIG. 2, the supplied pieces 3 under process are sorted out into four different size groups. By increasing the number of endless conveyors 2 disposed, the number of the different size groups which can be sorted out into is increased to obtain finer sorting.

Figure 5:
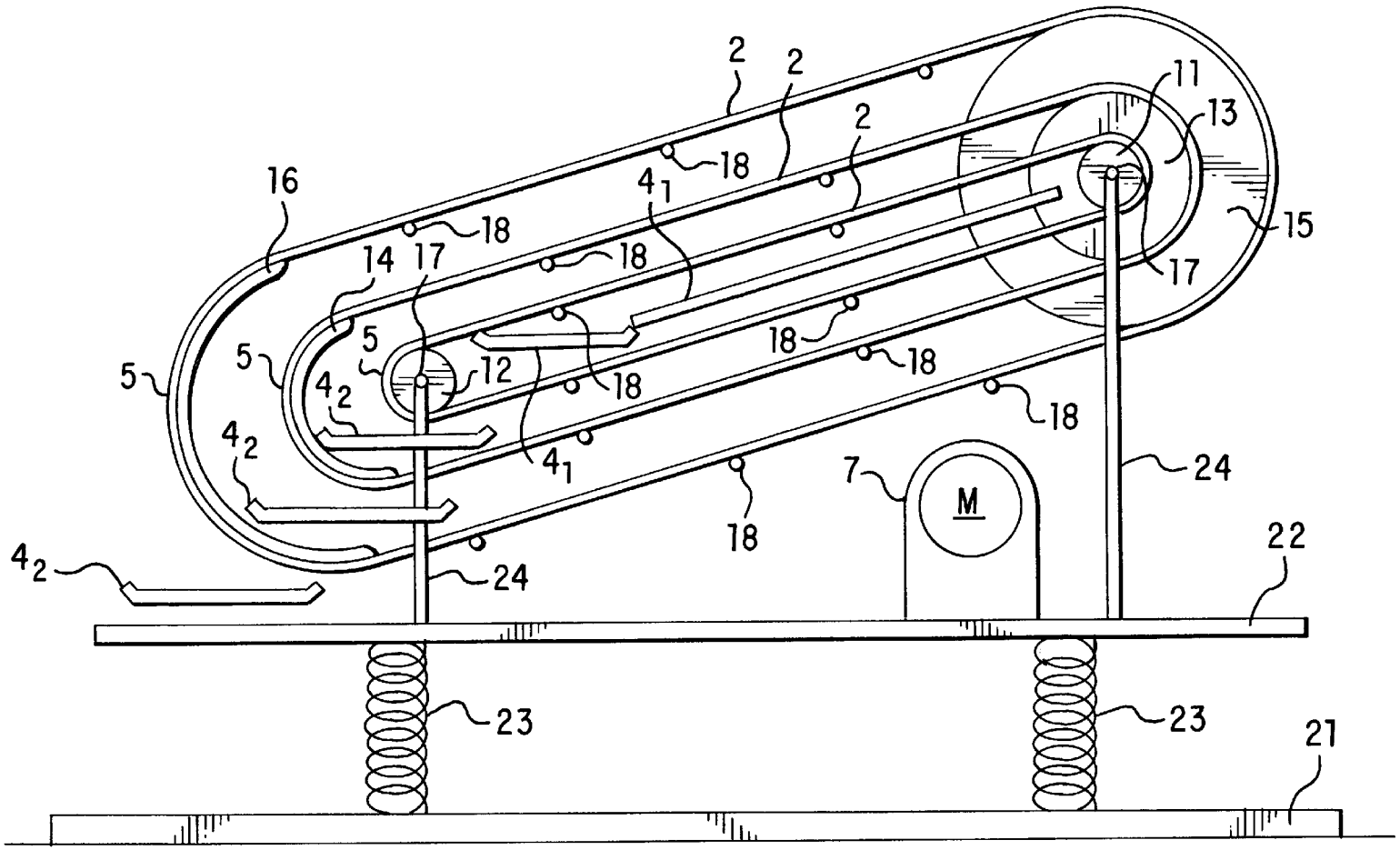
FIG. 5 is a side view showing a third embodiment of the automatic sorting apparatus according to the invention.

A third embodiment of the automatic sorting apparatus according to the invention will now be described with reference to FIG. 5. In the embodiment, endless conveyors 2 are inclined downward in the direction of conveying pieces 3 under process, and also adapted to be vibrated up and down and also back and forth. Pieces 3 under process conveyed on the endless conveyors 2 with the excursion thereof, are also allowed to slide along the endless conveyors 2 owing to the slope thereof, so that they can be more easily distributed uniformly over the endless conveyors 2. To cause vibration of the endless conveyors 2 in the FIG. 5 apparatus, coil springs 23 are disposed between a base 21 which is installed on the ground or floor and a support bed 22. The endless conveyors 2 are mounted on support legs 24 extending upright from the support bed 22. A vibrator 7 such as a motor M having a specific vibration number is mounted on the support bed 22. When the vibrator 7 is driven, its vibrations are transmitted to the endless conveyors 2 to cause vibration of the pieces 3 under process on the endless conveyors 2. The pieces 3 under process thus are spread over the entire top surface of the endless conveyors 2, thus facilitating their downward slicing and falling through the sorting holes 1. The vibrations further permit readier detachment of a piece 3 under process from a sorting hole 1 when the piece 3 is hooked therein. Thus, there results less catching of pieces 3 under process in sorting holes 1, and smoother sorting can be obtained. The pieces 3 under process which remain hooked in sorting holes 1 in spite of vibrations exerted to them, mostly fall off the U-turn portions 6 of the endless conveyors 2. Reference numeral 18 in FIG. 5 designates support members like those shown in FIGS. 1 and 2. Designated at 41 is an inner receiver, and at 44 outer receivers.

Figure 6A:
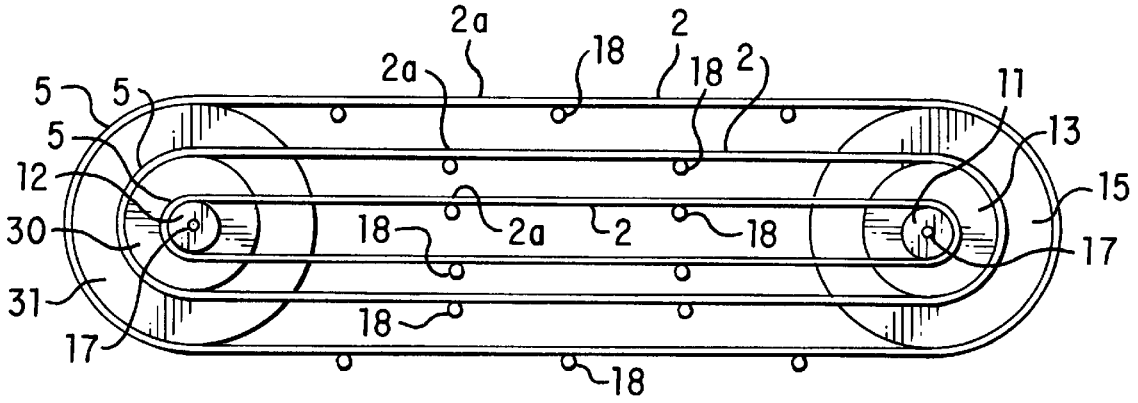
FIGS. 6A and 6B are a side view and a sectional view, respectively, showing a forth embodiment of the automatic sorting apparatus according to the invention.
Figure 6B:
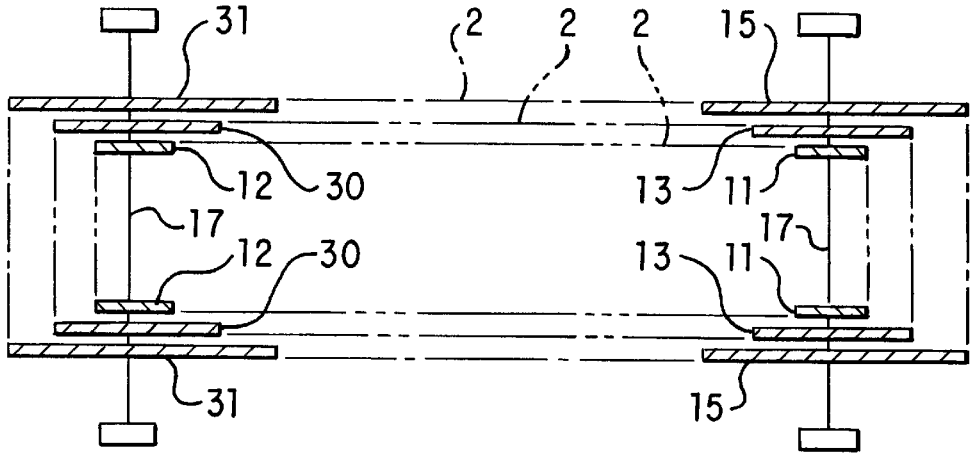

A fourth embodiment of the automatic sorting apparatus is shown in FIGS. 6A and 6B. This embodiment is the same as the previous FIG. 2 automatic sorting apparatus except for that while in the FIG. 2 the intermediate and outermost endless conveyors 2 among the three endless conveyors are passed round drive rolls 13 and 15 and guides 14 and 16, in the FIGS. 6A and 6B apparatus the intermediate and outermost endless conveyors 2 are also passed round the drive rolls 13 and 15 and driven rolls 30 and 31. In the FIGS. 6A and 6B apparatus, the driven rolls 30 and 31 are concentric with the drive roll 12.

With the drive rolls 11, 13 and 15 made concentric, the driven rolls 12, 30 and 31 made concentric and the three endless conveyors 2 passed round these rolls, the endless conveyors 2 have progressively smaller widths from the outermost endless conveyor 2, as shown in FIG. 6B. In this arrangement, pieces 3 under process that fall through sorting holes 1 formed in portions of the widest outermost endless conveyor 2 adjacent the width direction ends thereof may fall on the width direction width direction outside of the inner endless conveyor 2 having a smaller width. According to the invention, the wide outermost and intermediate endless conveyors 2 are formed with sorting holes 1 not over the entire width but only in an area having the same width as the innermost endless conveyor 2 lest pieces 3 under process falling through the sorting holes 1 formed in the width direction end portions of the widest outermost endless conveyor 2 should fall into the width direction outside of the inner endless conveyors. Alternatively, while sorting holes 1 are formed over the entire width of each of the endless conveyors 2, receivers are disposed below width direction end portions of each of the inner endless conveyors 2 to receive pieces 3 under process falling through the sorting holes 1 in the width direction end portions of the widest outermost endless conveyor 2 into the width direction outside of the narrower inner endless conveyor 2.

Figure 7:
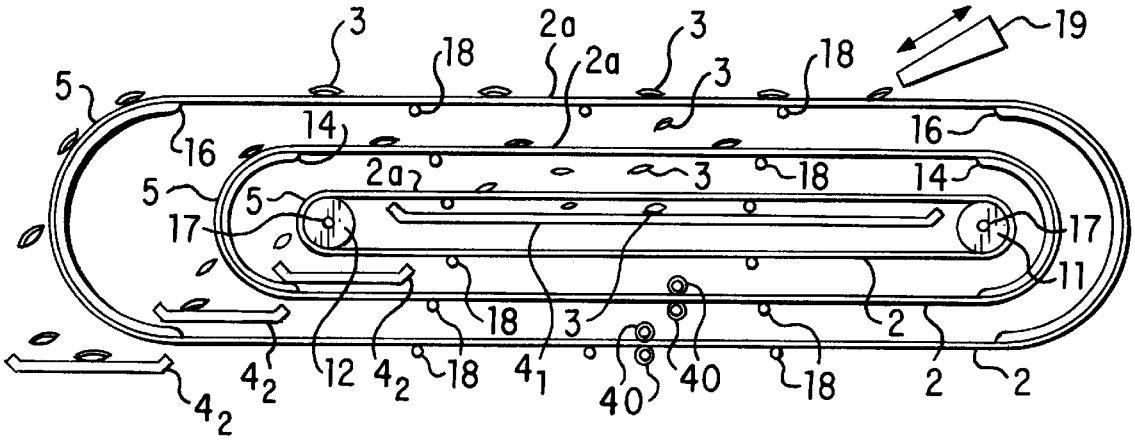
FIG. 7 is a side view showing a fifth embodiment of the automatic sorting apparatus according to the invention.

A fifth embodiment of the automatic sorting apparatus according to the invention will now be described with reference to FIG. 7. In the embodiment, while the innermost endless conveyor 2 among the three endless conveyors 2 is passed round the drive and driven roller 11 and 12 as in the FIG. 1 embodiment, the intermediate and outermost endless conveyors 2 are passed round arcuate guides 14 and 16 for excursion and each driven with rotation of two drive rolls 40 pinching the lower run.

Figure 8:
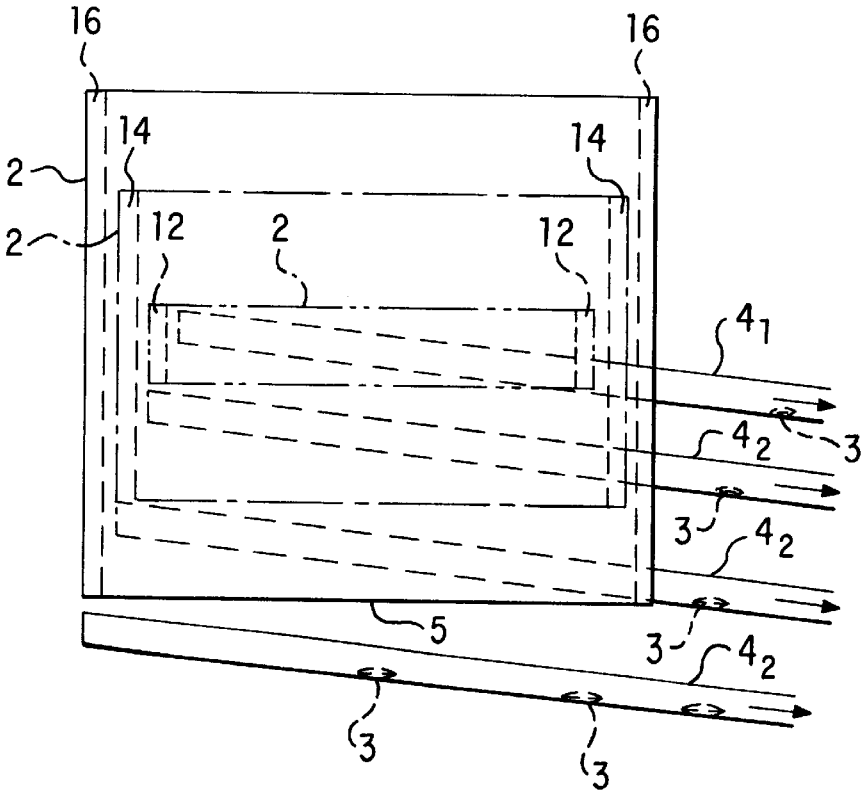
FIG. 8 is a side view showing a sixth embodiment of the automatic sorting apparatus according to the invention, specifically showing receivers as viewed from the front of U-turn portions of endless conveyors.

A sixth embodiment of the automatic sorting apparatus according to the invention will now be described with reference to FIG. 8. In this embodiment, the inner and outer receivers 41 and 42 are gutter-like shoots, which extend in width direction side-wise of the respective endless conveyors 2 and are inclined downward in the extending direction so that pieces 3 under process falling onto them can be automatically fed out to the outside. It is possible to cause vibrations of the inner and outer receivers 41 and 42 to feed out the pieces 3 under process.

Figure 9:
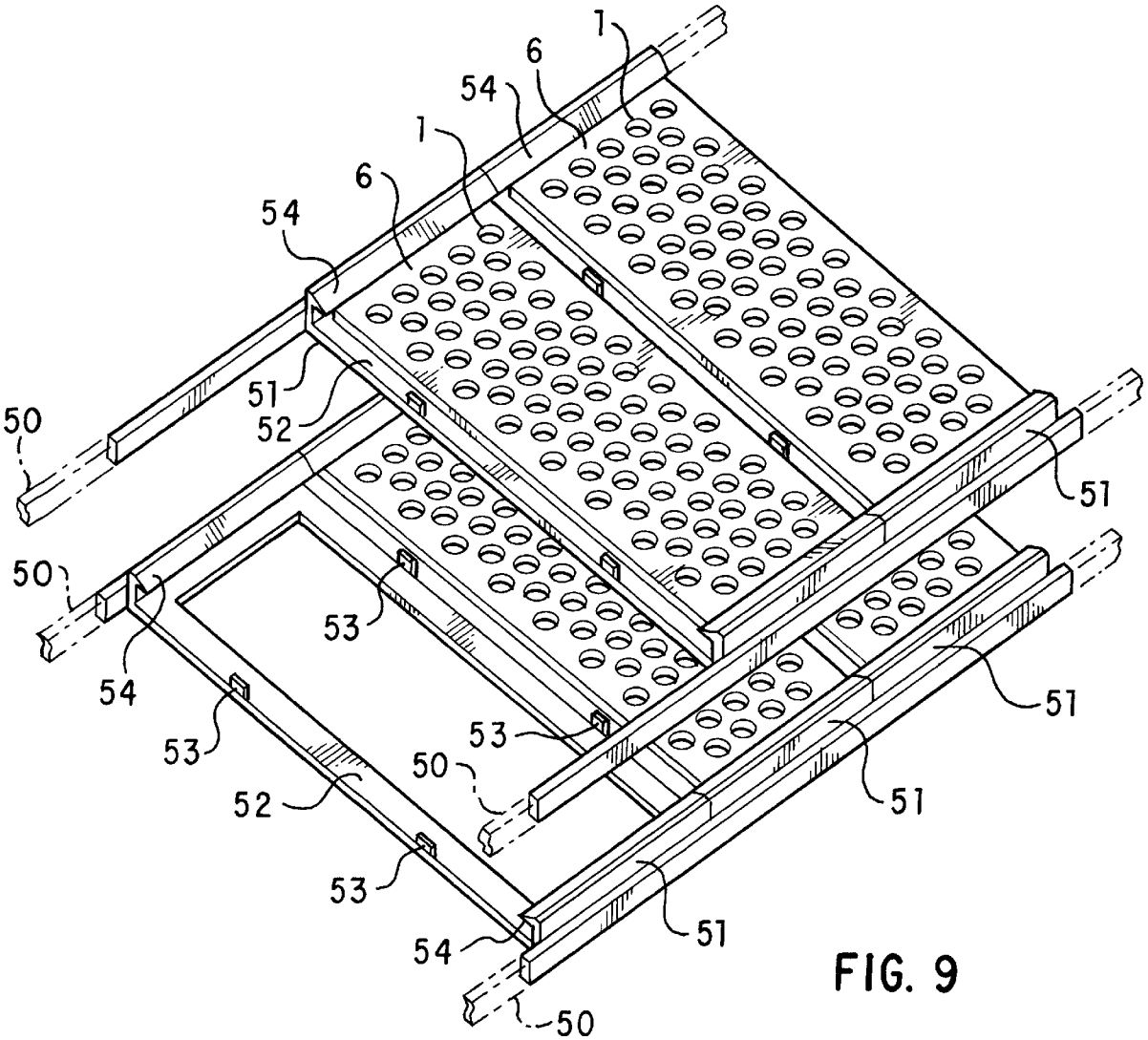
FIG. 9 is a fragmentary perspective view showing a seventh embodiment of the invention.

A seventh embodiment of the automatic sorting apparatus according to the invention will now be described with reference to FIGS. 9, 10A and 10B. In this embodiment, and endless excursion member 50 such as an endless chain, which has a number of receptacles 51 mounted on it, is passed round drive and driven rolls 11 and 12. A panel 6 made of a hard material and having a number of sorting holes 1, is accommodated in each receptacle 51 such that it can be vibrated. The receptacle 51 has an elongate frame 52 having front and rear stopper portions 53 and upper stepper portions 54. The elongate frame 52 and stopper portions 53 and 54 define a space, in which the panel 6, having slightly smaller dimensions, is accommodated. When the receptacle 51 is vibrated back and forth and also up and down, the accommodated panel 6 is also vibrated in the same directions. The receptacles 51 are vibrated directly, or the endless excursion member 50 is vibrated with a vibrator (not shown). If the width of the receptacle 51 in the process direction thereof is excessive, it is difficult for the receptacle 51 to be turned at the U-turn portion of the endless excursion member 50. Accordingly, desirable the receptacle 51 has a width posing no problem in turning round the U-turn portion 5. In addition, as shown in FIG. 10B, only a width direction central portion of the receptacle 51 is suitably mounted on the endless excursion member 50 so that width direction leading and trailing portions of the receptacle 51 become aloof from the endless excursion member 50 at the U-turn portion 5 thereof, thus permitting smooth turning of the receptacle 51 round the U-turn portion 5.

In this arrangement, if adjacent receptacles 51 are spaced apart excessively, pieces 3 under process may fall through the gap. For this reason, the gap is made as small as possible. As an example, the pieces 3 under process through sorted out in this apparatus are considerably large, with the diameter ranging from 10 to 20 cm. The gap noted above is set that the pieces 3 under process will not fall through it. To reliably prevent the falling of pieces 3 under process through the gap, a falling prevention member may be mounted in the gap. The falling prevention ember may be thin sheet having a greater width than the gap and tied between two parallel endless excursion members 50.

Suitably, the panel 6 is handily brought into and out of the receptacle 51. This is convenient for replacing a damaged panel 6 after long use with a new one. To this end, the upper stopper portion 54 shown in FIG. 9 may be adapted to be mounted on and dismounted from the elongate frame 52 by one tough operation or by screwing and unscrewing for bringing the panel 6 into and out of the elongate frame 52 from above by removing the upper stopper portion 54. Alternatively, the front and rear stopper portions 53 may be adapted to be mounted and dismounted so that they can be removed for bringing the panel 6 into and out of the elongate frame 52. As a further alternative, the elongate frame 52 may be formed with a side inlet/outlet opening and a lid is mounted to open and close the opening, so that the panel 6 can be brought into and out of the elongate frame 52 by opening the lid.

With the above arrangement that a number of panels 6 having sorting holes 1 are disposed for vibration in receptacle 51 capable of undergoing excursion, by vibrating the receptacles 51 undergoing excursion the accommodated panels 6 therein are also vibrated, thus causing vibrations of pieces 3 under process conveyed on the panels 6. With the vibrations, shellfish pieces 3 which may be conveyed in an overlapping fashion on the endless conveyor 2 can be dispersed to readily enter sorting holes 1 and be less easily caught in these holes 1.

With the disposition of a number of panels 6 with sorting holes 1 for vibration in receptacles 51 mounted on the endless excursion member 50 such as a chain, by vibrating the endless excursion member 50 or receptacles 51 undergoing excursion the panels 6 in the receptacles 1 can be vibrated to cause vibration of pieces 3 under process conveyed on the panels 6. With the vibrations thus exerted, pieces 3 under process which may be conveyed in an overlapped fashion on the endless conveyor 2 can be dispersed to readily enter sorting holes 1 and be less easily caught in the these holes 1.

Figure 11A:
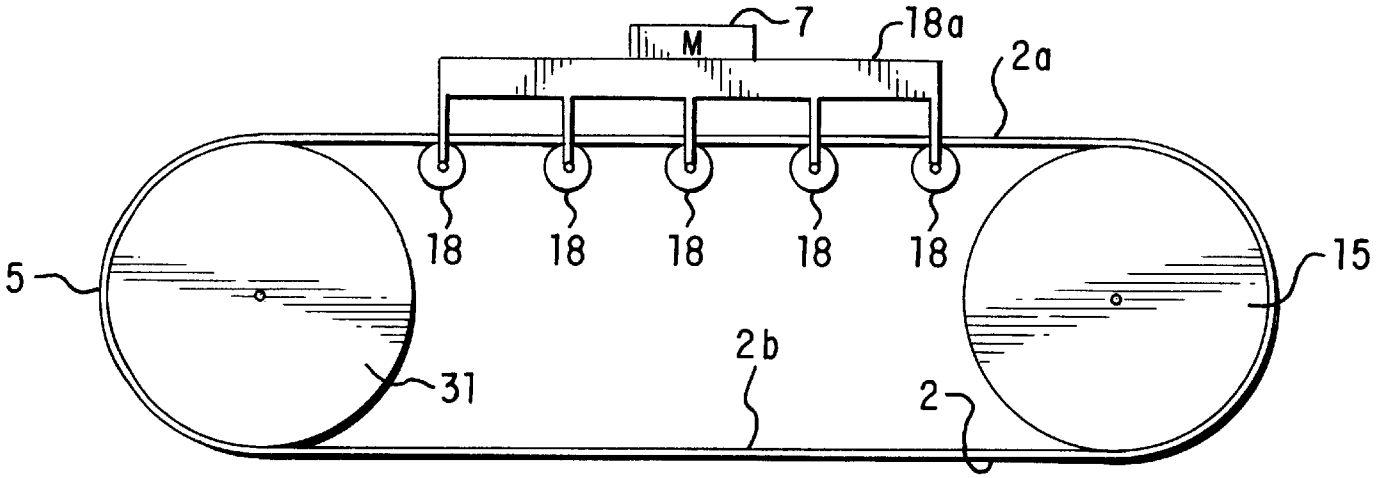
FIGS. 11A and 11B are a schematic side view and a schematic plan view, respectively, showing an eighth embodiment of the automatic sorting apparatus according to the invention.
Figure 11B:
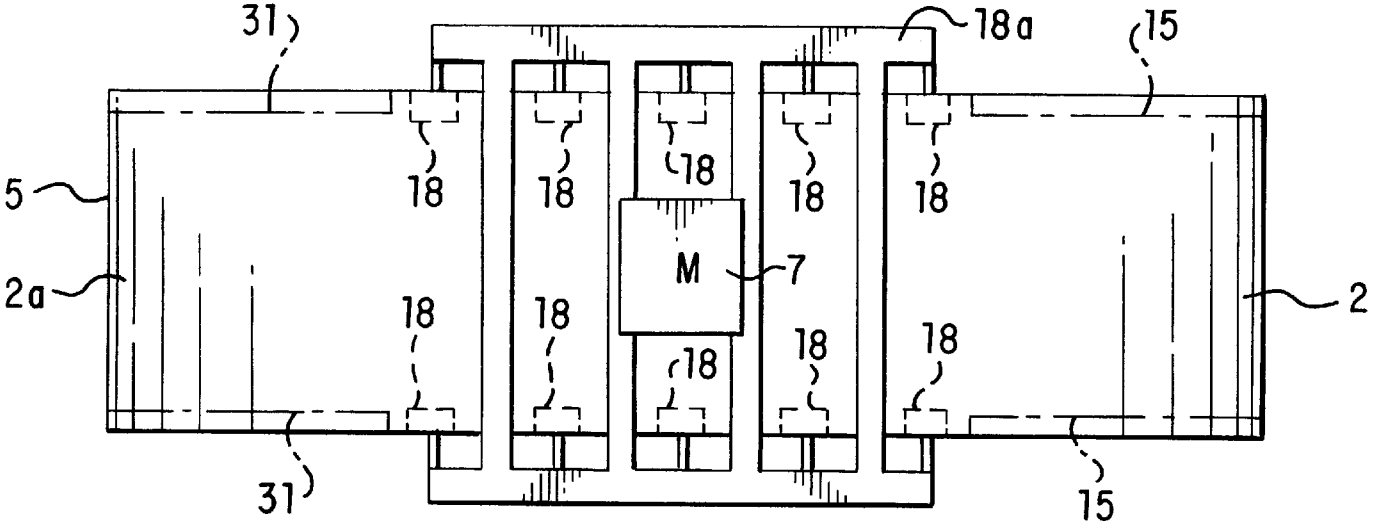

An eight embodiment of the automatic sorting apparatus will now be described with reference to FIGS. 11A and 11B. This embodiment is the same as the previous FIG. 1 automatic sorting apparatus except for that in this embodiment support members 18 are provided under the upper fun 2*a* of an endless running member so that the upper run 2*a* will not easily sag. The support members 18 are coupled together by a frame 18 *a,* and a vibrator 7 such as a vibrating motor M is mounted on the frame 18*a.* By causing vibrations of the support members 18 with the vibrator 7, the upper run 2*a* of the endless running member 2 is supported by by the support members 18 via vibrated. In this case, since the upper run 2*a* of the endless running member 2 is supported by the support members 10, the endless running member 2 is not detached form sprockets when it is vibrated by the vibrator 7. Since the endless running member 2 is vibrated by the vibrator 7 while undergoing excursion, pieces 3 under process conveyed in an overlapped state on the endless running member 2 can be dispersed by the vibrations to readily enter sorting holes 1 and be less caught in these holes 1. Moreover, since the support members 18 are vibrated by the vibrator 7, it is possible to cause vibrations of the endless running member 2 with a smaller size vibrator 7 than in the case of vibrating the endless running member 7 in the hole frame with the vibrator 7.

Figure 1B:
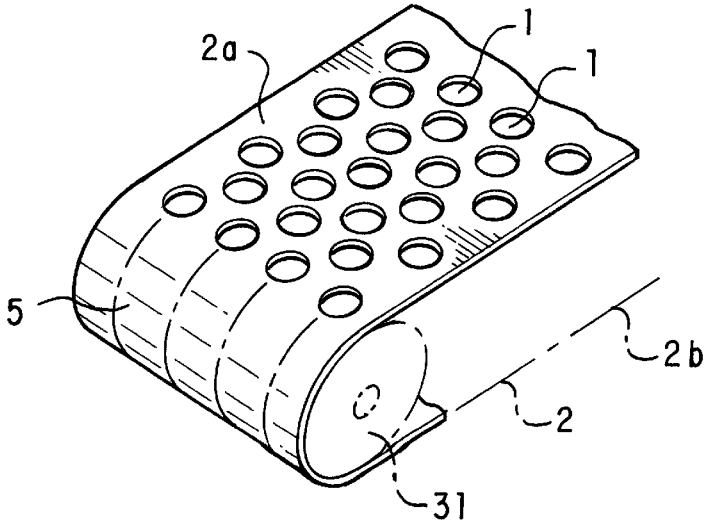

While the foregoing embodiments of the invention shown in FIGS. 1 to 11A and 11B used either a single or three endless conveyors 2, according to the invention it is possible to use any number of endless conveyors 2, for instance two or four endless conveyors as well. By increasing the number of endless conveyors used the number of different size groups of pieces 3 under process to be sorted out can be increased to increase the accuracy of sorting. The endless conveyor or conveyors 2 may be disposed such that the conveying direction is horizontal as shown in FIG. 1, or has a downward slope toward the outlet as shown in FIG. 5, or has an upward slope toward the outlet. Where a plurality of endless conveyors 2 are disposed one inside another a shown in FIG. 2, it is possible to set different excursion speeds of the individual endless conveyors 2. For example, the excursion speed may be set to the high for the outermost endless conveyor 2, which conveys a great amount of pieces 3 under process, for permitting quick sorting, and be reduced progressively inner endless conveyors 2 because the amount of pieces 3 under process is reduced for the progressively inner endless conveyors 2. Where a plurality of endless conveyors 2 are used, one of them (for instance the outermost endless conveyor) may comprise a single sheet as shown in FIG. 1B while the other endless conveyors 2 may each comprise a number of hard material panels 6 having sorting holes 1 and coupled to one another for bending as shown in FIGS. 3A, 3B and 4, or vice versa.

While the foregoing description concerned with shellfish as pieces 3 under process, the automatic sorting apparatus according to the invention can be used for sorting out not only shellfish but also various other items as well, such as fish, minerals, crop, industrial products, etc. In the case of a mineral or a hard industrial product, a hard material may be used for the panels 6 of the endless conveyor 2 or thin sheet 2*b.* Doing so makes the endless conveyor 2 to be less damaged. In the case of crop or a soft industrial product, a soft material may be sued for the endless conveyor 2. The sorting holes 1 may not be circular in shape, but various hole shapes such as angular and oval shapes may be chosen to meet the shape of the pieces 3 under process.

What is claimed is:

1. An automatic sorting apparatus comprising two or more endless conveyors having different excursion diameters and each comprised of a single rigid thin sheet having complete sorting holes formed independently and separately on the single rigid thin sheet so as to permit falling therethrough of pieces under process having at most a predetermined size and mounted on an endless excursion member of the endless conveyors, the two or more endless conveyors being disposed for excursion oat an interval between adjacent endless conveyors, the complete sorting holes of each of the endless conveyors being smaller than the complete sorting holes of the next outer adjacent endless conveyor, an inner receiver disposed on an inner side of the innermost endless conveyor for receiving pieces under process falling through the complete sorting holes of the innermost conveyor during travel of the innermost endless conveyor, the inner receiver being separate from the innermost endless conveyor, outer receivers such that one outer receiver is associated with each of the endless conveyors, each outer receiver being disposed outside and below a U-turn portion of the endless conveyor with which it is associated for receiving pieces under process falling off the endless conveyor at the U-turn portion of the endless conveyor, the outer receivers except the outermost outer receiver also being disposed between adjacent endless conveyors, wherein either or both the inner receiver and outer receivers comprise revolving conveyors to convey pieces under process falling onto the inner receiver and outer receivers out of the automatic sorting apparatus, and a vibrator for vibrating all of the endless conveyors up and down.

2. The automatic sorting apparatus according to claim 1, wherein the endless conveyors are supported by a support member and the vibrator vibrates the endless conveyors up and down by vibrating the support member.

3. The automatic sorting apparatus according to claim 1, wherein the endless conveyors are sloped downward in the direction of conveying of the pieces under process.

4. An automatic sorting apparatus comprising two or more endless conveyors having different excursion diameters and each comprised of a number of rigid panels attached for flexibility and mounted on an endless excursion member of the endless conveyors and having complete sorting holes formed independently and separately on each of the rigid panels so as to permit falling therethrough of pieces under process having at most a predetermined size, the two or more endless conveyors being disposed for excursion at an interval between adjacent endless conveyors, the complete sorting holes of each of the endless conveyors being smaller than the complete sorting holes of the next outer adjacent endless conveyor, an inner receiver disposed on an inner side of the innermost endless conveyor for receiving pieces under process falling through the complete sorting holes of the innermost conveyor during travel of the innermost endless conveyor, the inner receiver being separate from the innermost endless conveyor, outer receivers such that one outer receiver is associated with each of the endless conveyors, each outer receiver being disposed outside and below a U-turn portion of the endless conveyor with which it is associated for receiving pieces under process falling off the endless conveyor at the U-turn portion of the endless conveyor, the outer receivers except the outermost outer receiver also being disposed between adjacent endless conveyors, wherein either or both the inner receiver and outer receivers comprise revolving conveyors to convey pieces under process falling onto the inner receiver and outer receivers out of the automatic sorting apparatus, and a vibrator for vibrating all of the endless conveyors up and down.

5. The automatic sorting apparatus according to claim 4, wherein the endless conveyors are supported by a support member and the vibrator vibrates the endless conveyors up and down by vibrating the support member.

6. The automatic sorting apparatus according to claim 4, wherein the endless conveyors are sloped downward in the direction of conveying of the pieces under process.

7. An automatic sorting apparatus comprising two or more endless conveyors having different excursion diameters and each comprised of a number of rigid panels provided for vibration in receptacles of the endless conveyors and having complete sorting holes formed independently and separately on each of the rigid panels so as to permit falling therethrough of pieces under process having at most a predetermined size, the two or more endless conveyors being disposed for excursion at an interval between adjacent endless conveyors, the complete sorting holes of each of the endless conveyors being smaller than the complete sorting holes of the next outer adjacent endless conveyor, an inner receiver disposed on an inner side of the innermost endless conveyor for receiving pieces under process falling through the complete sorting holes of the innermost conveyor during travel of the innermost endless conveyor, the inner receiver being separate from the innermost endless conveyor.

outer receivers such that one outer receiver is associated with each of the endless conveyors, each outer receiver being disposed outside and below a U-turn portion of the endless conveyor with which it is associated for receiving pieces under process falling off the endless conveyor at the U-turn portion of the endless conveyor, the outer receivers except the outermost outer receiver also being disposed between adjacent endless conveyors, wherein either or both the inner receiver and outer receivers comprise revolving conveyors to convey pieces under process falling onto the inner receiver and outer receivers out of the automatic sorting apparatus, and a vibrator for vibrating all of the endless conveyors up and down.

8. The automatic sorting apparatus according to claim 7, wherein the endless conveyors are supported by a support member and the vibrator vibrates the endless conveyors up and down by vibrating the support member.

9. The automatic sorting apparatus according the claim 7, wherein the endless conveyors are sloped downward in the direction of conveying of the pieces under process.

* * * * *